US010362909B2

(12) United States Patent
Chang

(10) Patent No.: US 10,362,909 B2
(45) Date of Patent: Jul. 30, 2019

(54) PAPER DISPENSING DEVICE

(71) Applicant: Guangzhou Faner Aroma Product Co., Ltd., Guangzhou, Guangdong (CN)

(72) Inventor: Hsu-Hui Chang, Guangzhou (CN)

(73) Assignee: GUANGZHOU FANER AROMA PRODUCT CO., LTD., Guangzhou, Guangdong (CN)

( * ) Notice: Subject to any disclaimer, the term of this patent is extended or adjusted under 35 U.S.C. 154(b) by 71 days.

(21) Appl. No.: 15/817,306

(22) Filed: Nov. 20, 2017

(65) Prior Publication Data

US 2019/0150678 A1 May 23, 2019

(51) Int. Cl.
*A47K 10/36* (2006.01)

(52) U.S. Cl.
CPC ..... *A47K 10/3643* (2013.01); *A47K 10/3637* (2013.01)

(58) Field of Classification Search
CPC ..... A47K 10/0643; A47K 10/0637; A47K 10/0631
See application file for complete search history.

(56) References Cited

U.S. PATENT DOCUMENTS 1,811,537 A * 6/1931 Cummings ..... A47K 17/003 83/300
4,621,755 A * 11/1986 Granger ..... A47K 10/3656 225/106
4,635,837 A * 1/1987 Granger ..... A47K 10/3687 225/106
4,676,131 A * 6/1987 Cassia ..... A47K 10/3643 83/208
4,712,461 A * 12/1987 Rasmussen ..... A47K 10/3643 225/106
5,048,386 A * 9/1991 DeLuca ..... A47K 10/3643 225/106
6,314,850 B1 * 11/2001 Morand ..... A47K 10/3643 83/322
6,474,209 B1 * 11/2002 Granger ..... A47K 10/3643 221/30
7,571,670 B2 * 8/2009 Formon ..... A47K 10/3643 225/96
8,555,761 B2 * 10/2013 Keily ..... B26D 1/125 83/343

(Continued)

*Primary Examiner* — Jason Daniel Prone
*Assistant Examiner* — Richard D Crosby, Jr.
(74) *Attorney, Agent, or Firm* — Leong C. Lei

(57) ABSTRACT

The paper dispensing device includes a main spindle, an axle, two end pieces, and a cutting member. The main spindle has a compartment. The axle is rotatably supported inside the compartment. The end pieces are positioned adjacent to the two ends of the axle, respectively. Each end piece has an eccentric opening through which an end of the axle is threaded. A ring groove is configured around the eccentric opening along an inner side of each end piece. The cutting member includes a blade, a cutter axle, two arms extended outward slantwise from the cutter axle's two ends, and two guiding elements at the arms' outer ends moveably housed in the ring grooves, respectively. As the main spindle spins, the cutting member rotates along with the main spindle and its blade is extended out or retracted into the compartment as the guiding elements move along the ring grooves.

9 Claims, 9 Drawing Sheets

(56) References Cited

U.S. PATENT DOCUMENTS

| | | | | |
|---|---|---|---|---|
| 2002/0109034 | A1* | 8/2002 | Moody | A47K 10/3687 242/559.1 |
| 2006/0236832 | A1* | 10/2006 | Cvjetkovic | A47K 10/38 83/337 |
| 2007/0079676 | A1* | 4/2007 | Friesen | B26D 1/425 83/37 |
| 2012/0167734 | A1* | 7/2012 | Hansen | A47K 10/3643 83/337 |
| 2013/0192437 | A1* | 8/2013 | Sahlberg | B65H 35/0006 83/304 |
| 2014/0116216 | A1* | 5/2014 | Morand | A47K 10/36 83/175 |
| 2017/0042391 | A1* | 2/2017 | Morand | A47K 10/3643 |
| 2017/0188760 | A1* | 7/2017 | Henson | A47K 10/22 |

* cited by examiner

PAPER DISPENSING DEVICE

BACKGROUND OF THE INVENTION

(a) Technical Field of the Invention

The present invention generally relates to paper dispensers, and more particularly to a paper dispenser with an automated paper cutter incorporated in the dispenser.

(b) Description of the Prior Art

It is a common practice to have a blade integrated with a paper dispenser to cut a length of paper from an installed roll of paper towel, toilet paper, etc.

The blade is usually disposed at where the paper is pulled out. After a length of paper is pulled out, a user drags the length of paper towards the blade so it may be cut from the roll. Usually the length of paper is torn to pieces or has a jagged edge. Also the length of paper is sometimes longer than what is really needed, leading to unnecessary waste of paper.

Currently there are paper dispensers with a linked cutter. As the paper is pulled down, the spindle for the roll of paper engages the cutter to move towards the paper. However, the mechanism for linking the spindle and the cutter takes up quite some space, resulting in a sizable paper dispenser, and making the downsizing of the paper dispenser rather difficult.

SUMMARY OF THE INVENTION

A major objective of the present invention is to provide a novel paper dispensing device which includes a main spindle having a compartment, two through openings at both ends, and a first slot opening on a lateral surface of the main spindle connecting the compartment; an axle rotatably supported inside the compartment, whose two ends are extended outside the main spindle via the through openings, respectively; two end pieces positioned adjacent to the two ends of the axle and the through openings, respectively, where each end piece has an eccentric opening through which an end of the axle is threaded, a ring groove is configured around the eccentric opening along an inner side of each end piece, and an axially and outward protruding first positioning element is configured on an outer side of each end piece extending through one of the through openings; and a cutting member including a blade, a cutter axle along a major edge of the blade, two arms extended outward slantwise from the axle's two ends, and two guiding elements at the arms' outer ends moveably housed in the ring grooves, respectively. The cutting member is positioned along the first slot opening. The main spindle, the axle, and the cutting member are rotated synchronously. The end pieces and their ring grooves are fixed by the first positioning elements. As the main spindle spins, the cutting member rotates along with the main spindle and its blade is extended or retracted through the first slot opening as the guiding elements move along the ring grooves.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings, identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
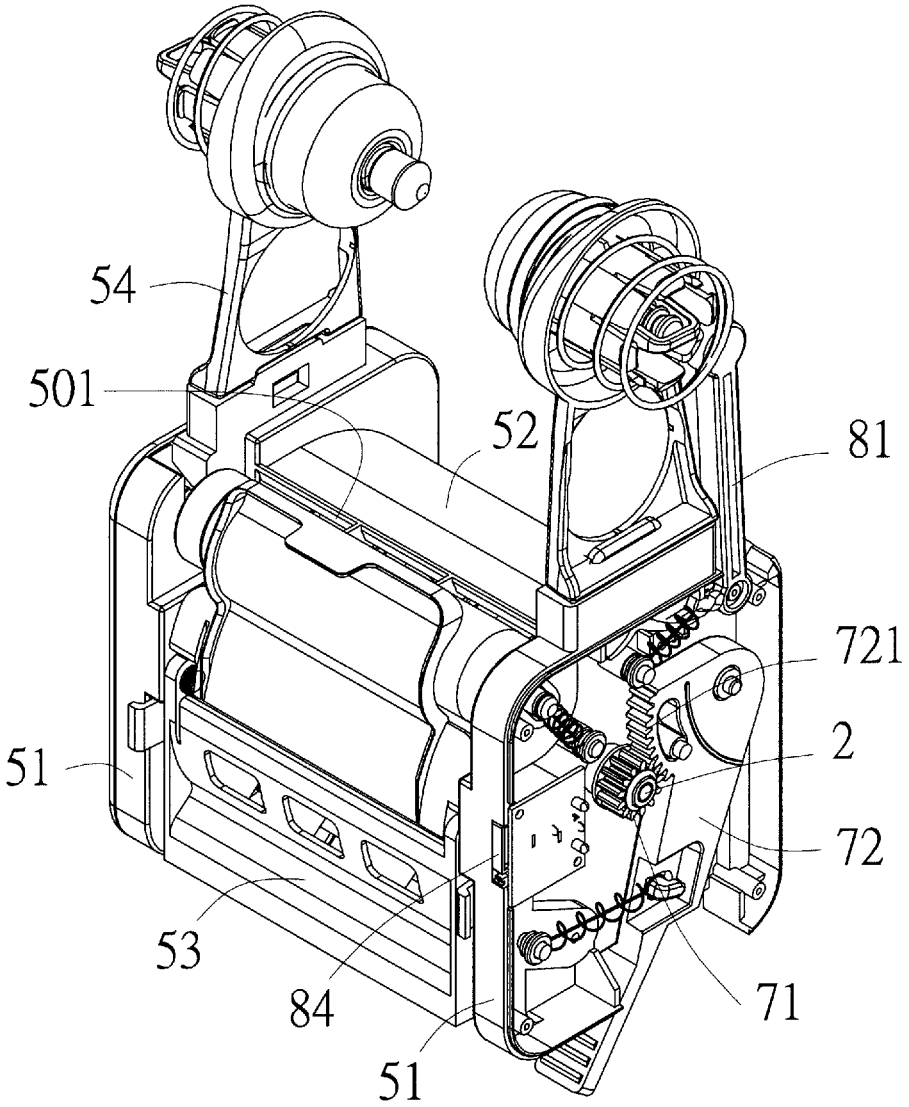
FIG. 1 is perspective diagram showing a paper dispensing device according to an embodiment of the present invention.

The following descriptions are exemplary embodiments only and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 5, a paper dispensing device according to an embodiment of the present invention includes a main spindle 1, an axle 2, two end pieces 3, a cutting member 4, and a rack 5.

The main spindle 1 includes a first half cylinder 11 and a second half cylinder 12. The first and second half cylinders 11 and 12 includes lateral surfaces 111 and 121, and end surfaces 112 and 122 at both ends, respectively. The first and second half cylinders 11 are 12 are joined to form a cylinder with a compartment 10 inside, two through openings 101 at the both ends, and an end-to-end first slot opening 102 on the lateral surface of the cylinder. The main spindle 1 further includes a tubular sleeve 13 having a C-shaped cross section and an end-to-end second slot opening (not numbered). The cylinder formed by the first and second half cylinders 11 and 12 is threaded in the tubular sleeve 13. The lateral surface of the tubular sleeve 13 becomes the lateral surface of the main spindle 1. The compartment 10 is exposed through the first slot opening 102 and the second slot opening of the tubular sleeve 13.

The axle 2 is housed in the compartment 10. Inside the first and second half cylinders 11 and 12, there are corresponding support elements 104, respectively. When the first and second half cylinders 11 and 12 are joined, their support elements 104 match against each other and jointly provide an axle channel wrapping the axle 2. The axle 2's two ends are extended outside the main spindle 1 via the through openings 101, respectively.

Figure 7:
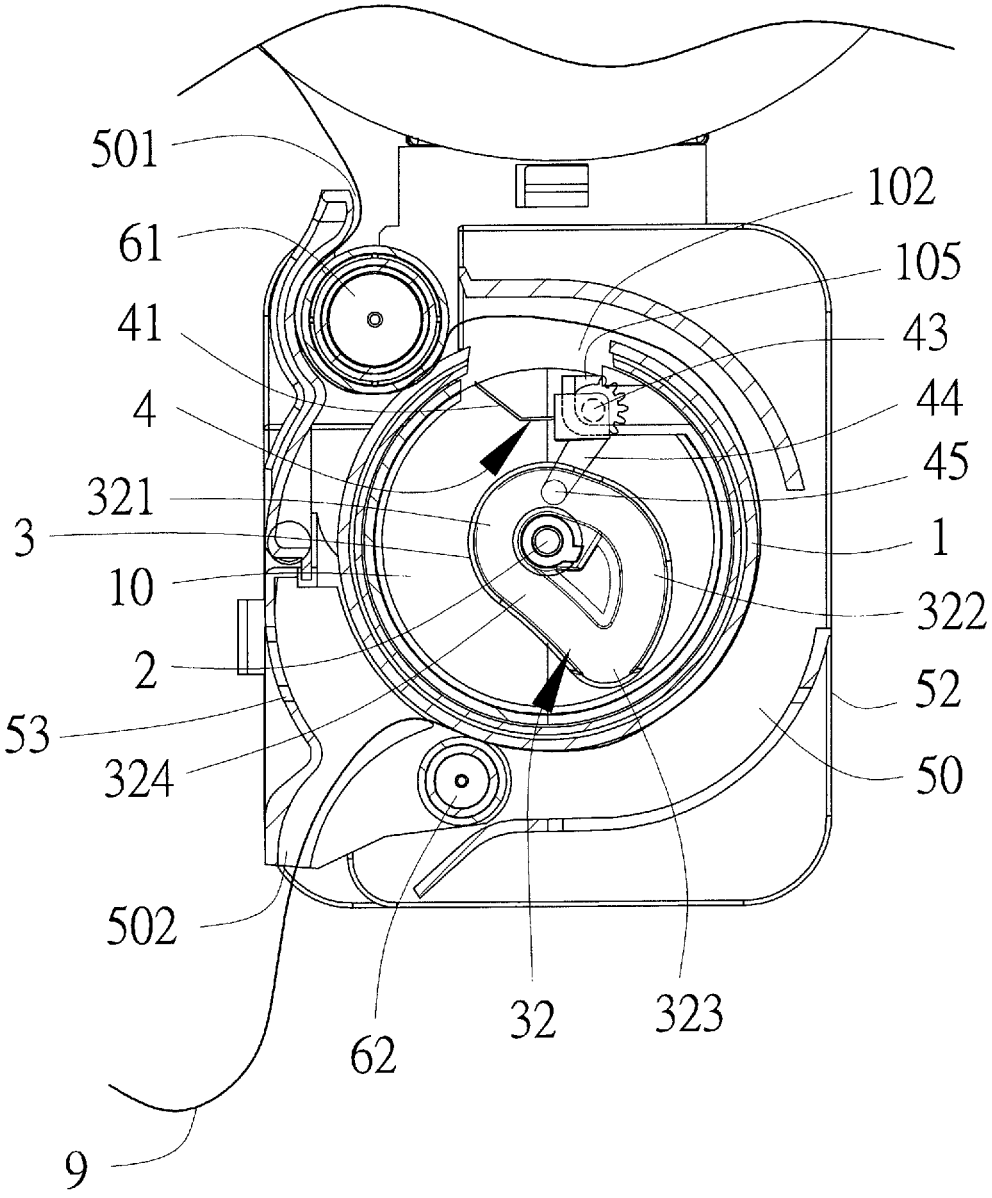
FIG. 7 is a sectional diagram showing the paper dispensing device of FIG. 6 before a length of paper is pulled from the paper dispensing device.

The two end pieces 3 are positioned adjacent to the two ends of the axle 2 and the through openings 101, respectively. Each end piece 3 has an eccentric opening 31 where an end of the axle 2 is threaded through. Along an inner side of each end piece 3 facing the support elements 104, a ring groove 32 is configured around the eccentric opening 31. The ring groove 32, as shown in FIG. 7, includes a semi-circular segment 321 around the eccentric opening 31, a corner segment 323 opposing the semi-circular segment 321, a curved segment 322 connecting the semi-circular segment 321 and the corner segment 323, and a linear segment 324 opposite to the curved segment 323 also connecting the semi-circular segment 321 and the corner segment 323. An outer side of each end piece 3 has an axially and outward protruding positioning element 33 extending through a through opening 101.

There is at least a partition 103 running perpendicularly through the first slot opening 102. The cutting member 4 includes an elongated blade 41, a cutter axle 43 along a major edge of the blade 41, two arms 44 extended outward slantwise from the cutter axle 43's two ends, and two guiding elements 45 at the arms 44's outer ends, respectively. Each guiding element 45 may be a roller. Two sockets 105 are provided inside the compartment 10 adjacent to the first slot opening 102 for rotatably housing the cutter axle 43's two ends. The cutting member 4 is therefore positioned along the first slot opening 102. The guiding elements 45 are movably housed in the ring grooves 32, respectively. The blade 41 has at least a notch 42 corresponding to and accommodating the partition 103.

The rack 5 includes two side covers 51, a back cover 52, and a front cover 53. The back and front covers 52 and 53 are configured between the side covers 51 so that an accommodation space 50 is formed among the side, back, and front covers 51, 52, and 53. Each side cover 51 has an axle socket 511 on an inner wall surrounded a positioning element 512. The positioning elements 512 and 33 are all tubular shaped. The main spindle 1 is pivotally mounted inside the accommodation space 50 by having the axle 2's two ends plugged into the axle sockets 512 and secured by the interlocking between the positioning elements 512 and 33. A paper roll support rack 54 is configured on a top side of each side cover 51. A paper input slot 501 is formed between top sides of the front and back covers 53 and 52, and a paper output slot 502 is formed between bottom sides of the front and back covers 53 and 52. An upper auxiliary spindle 61 and a lower auxiliary spindle 62 are also configured between the side covers 51, where the upper auxiliary spindle 61 is adjacent and parallel to the paper input slot 501 and the lower auxiliary spindle 62 is adjacent and parallel to the paper output slot 502.

Figure 6:
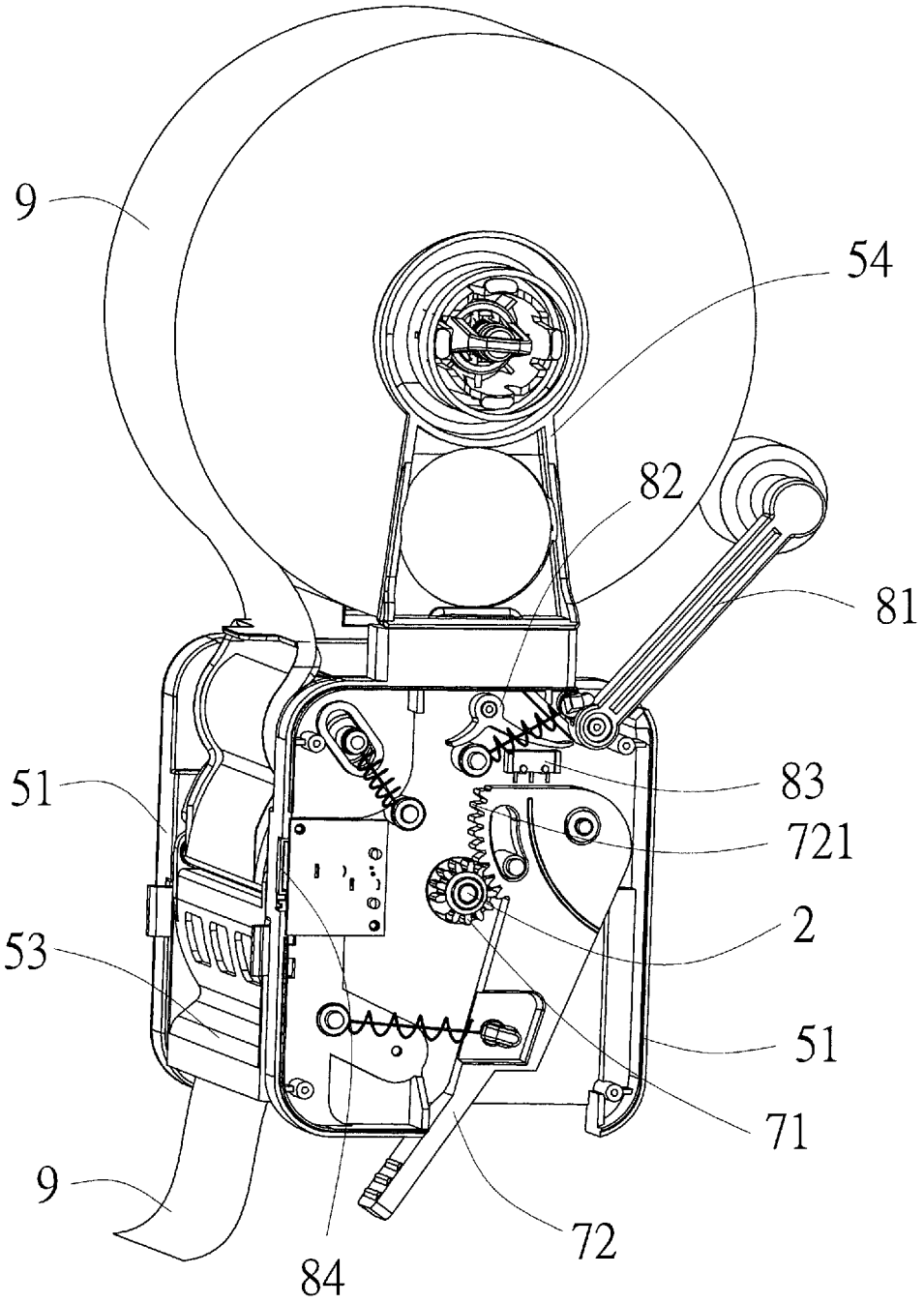
FIG. 6 is a perspective diagram showing the paper dispensing device of FIG. 1 is put to use.
Figure 8:
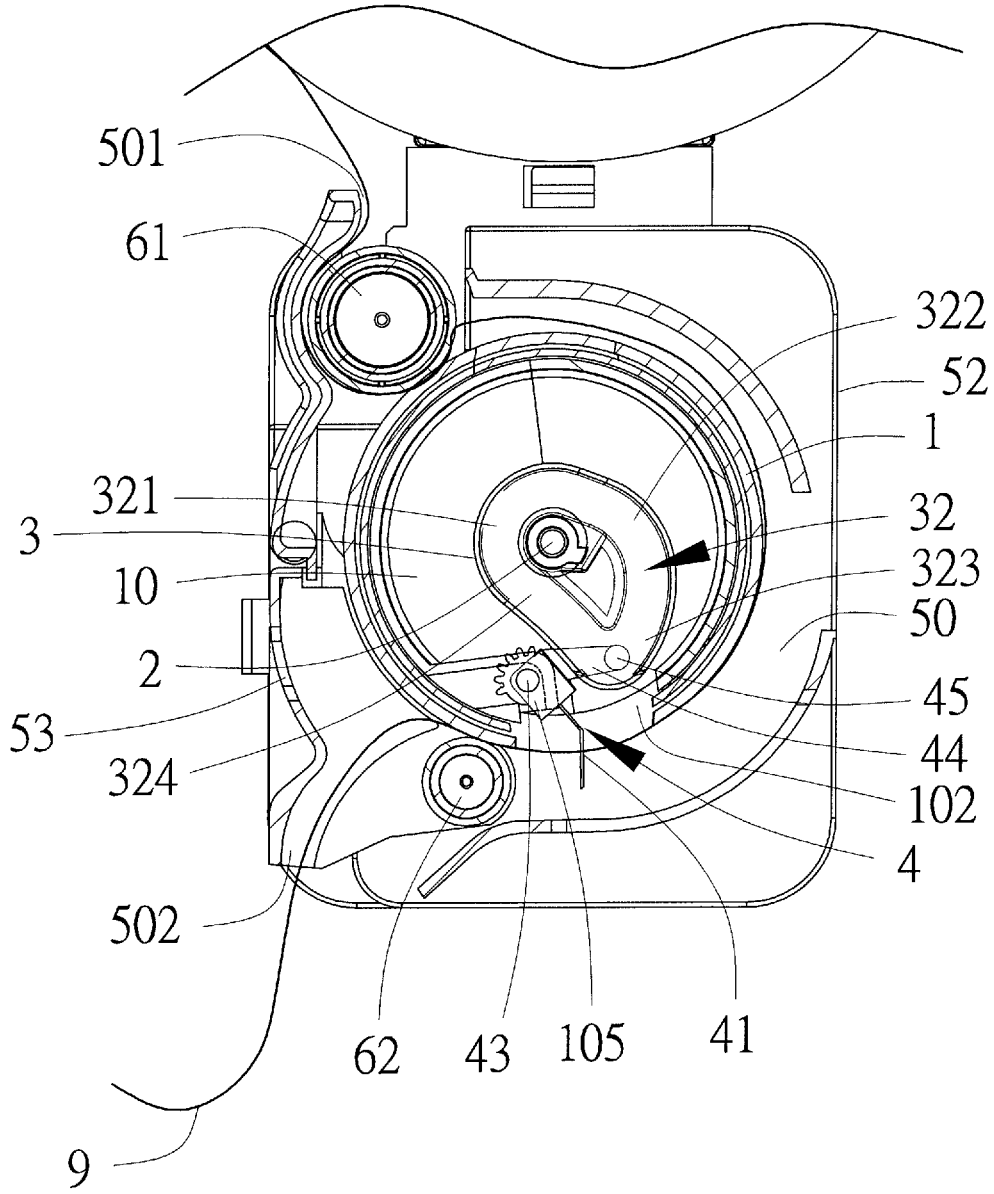
FIG. 8 is another sectional diagram showing the paper dispensing device of FIG. 6 after a length of paper is pulled from the paper dispensing device.

As shown in FIGS. 6 to 8, a paper roll 9 is pivotally mounted between the support racks 54. The paper roll 9 may be a roll of toilet paper, tissue paper, paper towel, or napkin. The paper roll 9's paper is extended into the paper input slot 501, through the accommodation space 50, and out of the paper output slot 502. As the paper runs through the accommodation space 50, it goes between the upper auxiliary spindle 61 and the main spindle 1, around the main spindle 1, and then between the lower auxiliary spindle 62 and the main spindle 1. As the paper is pulled from the paper output slot 502, the paper engages the main spindle 1, the axle 2, and the cutting member 4 to spin. The end pieces 3 are locked by the positioning elements 33 and 512 and therefore do not spin. However, as the main spindle 1 spins, the cutting member 4 rotates along with the main spindle 1 and its blade 41 is extended or retracted through the first slot opening 102 as the guiding elements 45 move along the ring grooves 32. When the guiding elements 45 moves from the semi-circular segments 321, via the curved segments 322, and to the corner segments 323 along the ring groove 32, the blade 41 supported by the arms 44 are extended out of the first slot opening 102 to cut off the paper. In the meantime, the partition 103 blocks the notch 42 and confines the range of the blade 41's extension. As the guiding elements 45 subsequently moves through the linear segments 324 back to the semi-circular segments 321 along the ring grooves 32, the arms 44 retract the blade 41 into the compartment 10.

The paper dispensing device of the present embodiment is able to prevent the paper from being torn to pieces or having a jagged edge. Also the length of paper would not be longer than what is needed. By having the ring groove 32 configured inside the main spindle 1, the present embodiment also may be better downsized and miniaturized.

Figure 3:
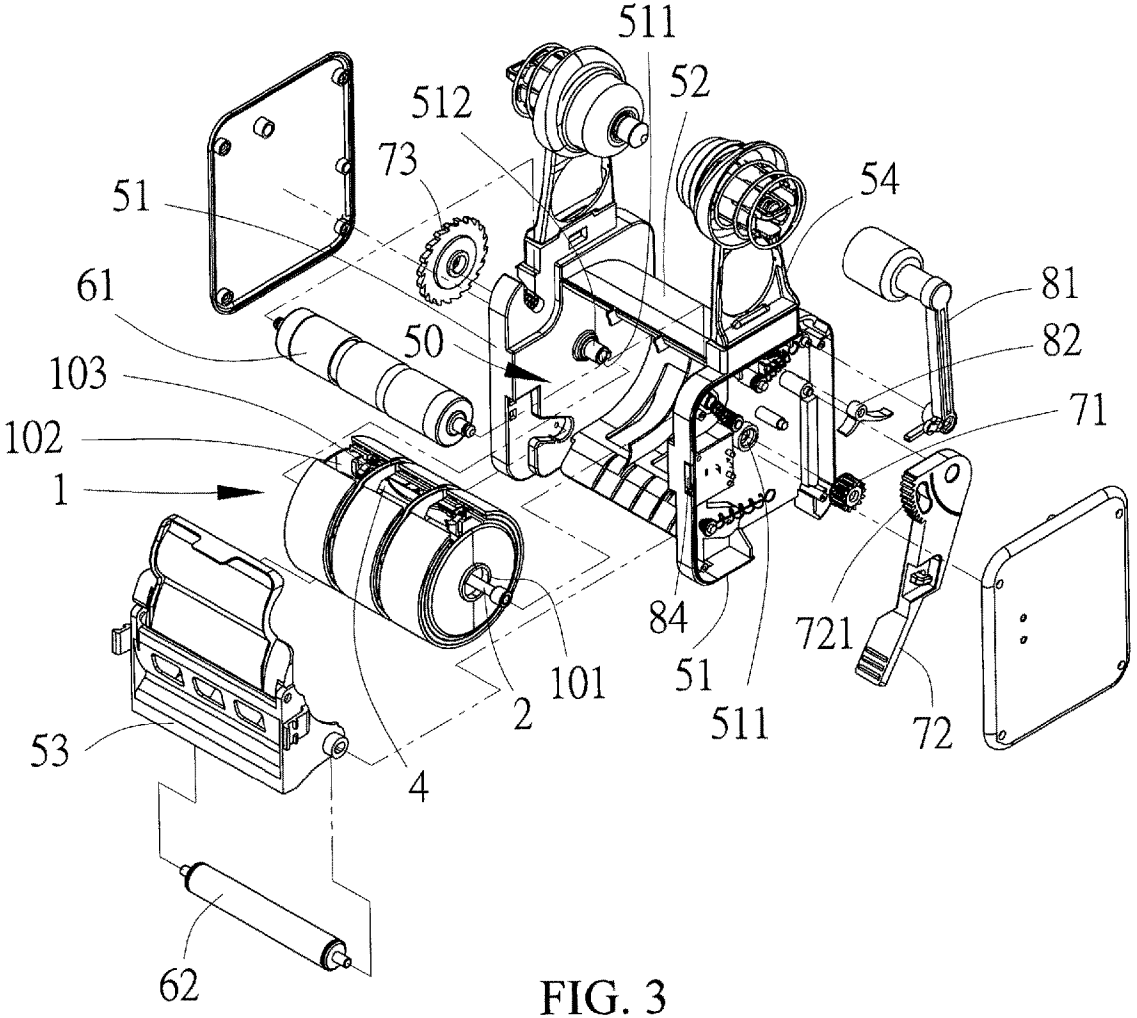
FIG. 3 is a perspective break-down diagram showing the various components of the paper dispensing device of FIG. 1.
Figure 4:
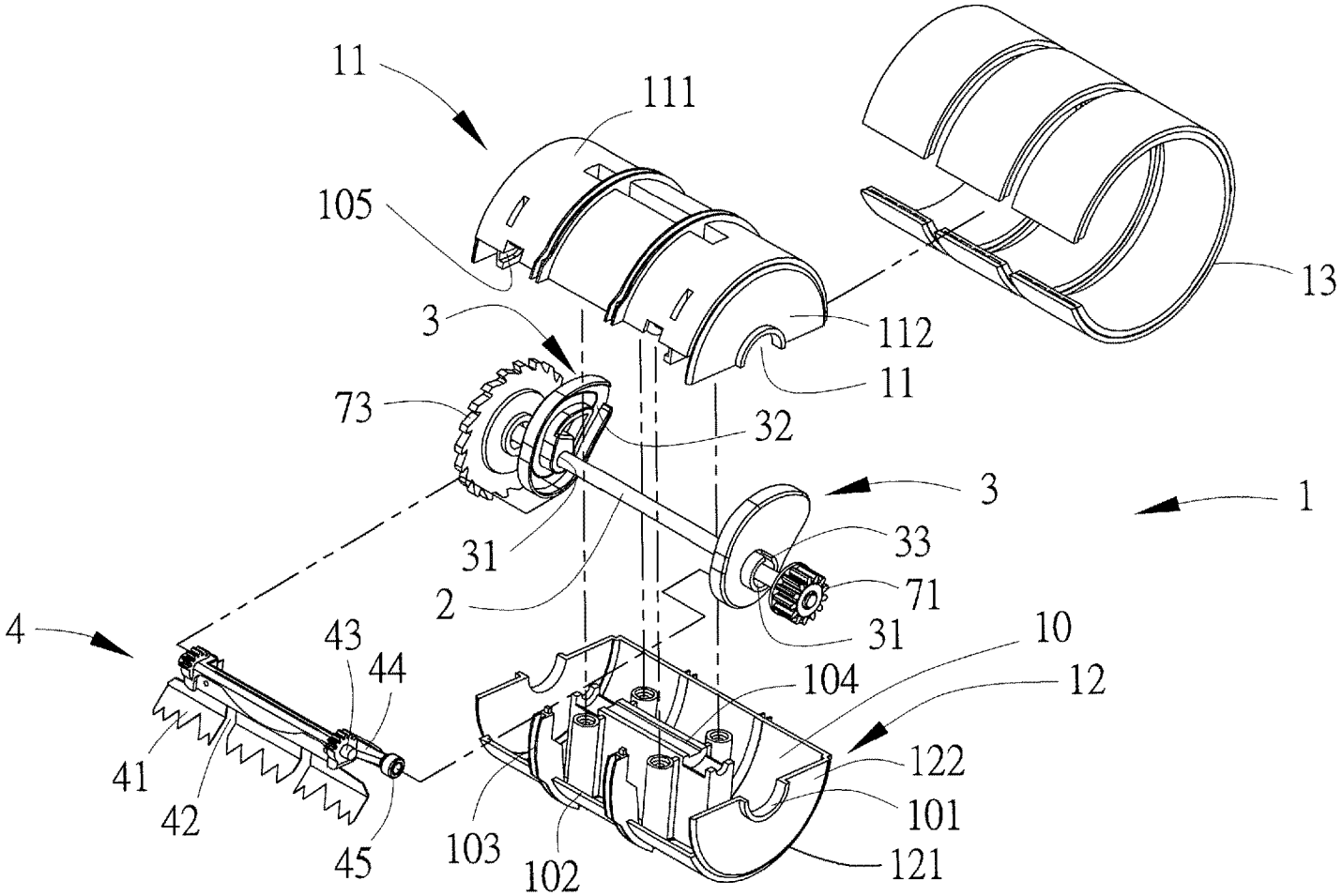
FIG. 4 is a perspective break-down diagram showing a main spindle of the paper dispensing device of FIG. 3.
Figure 5:
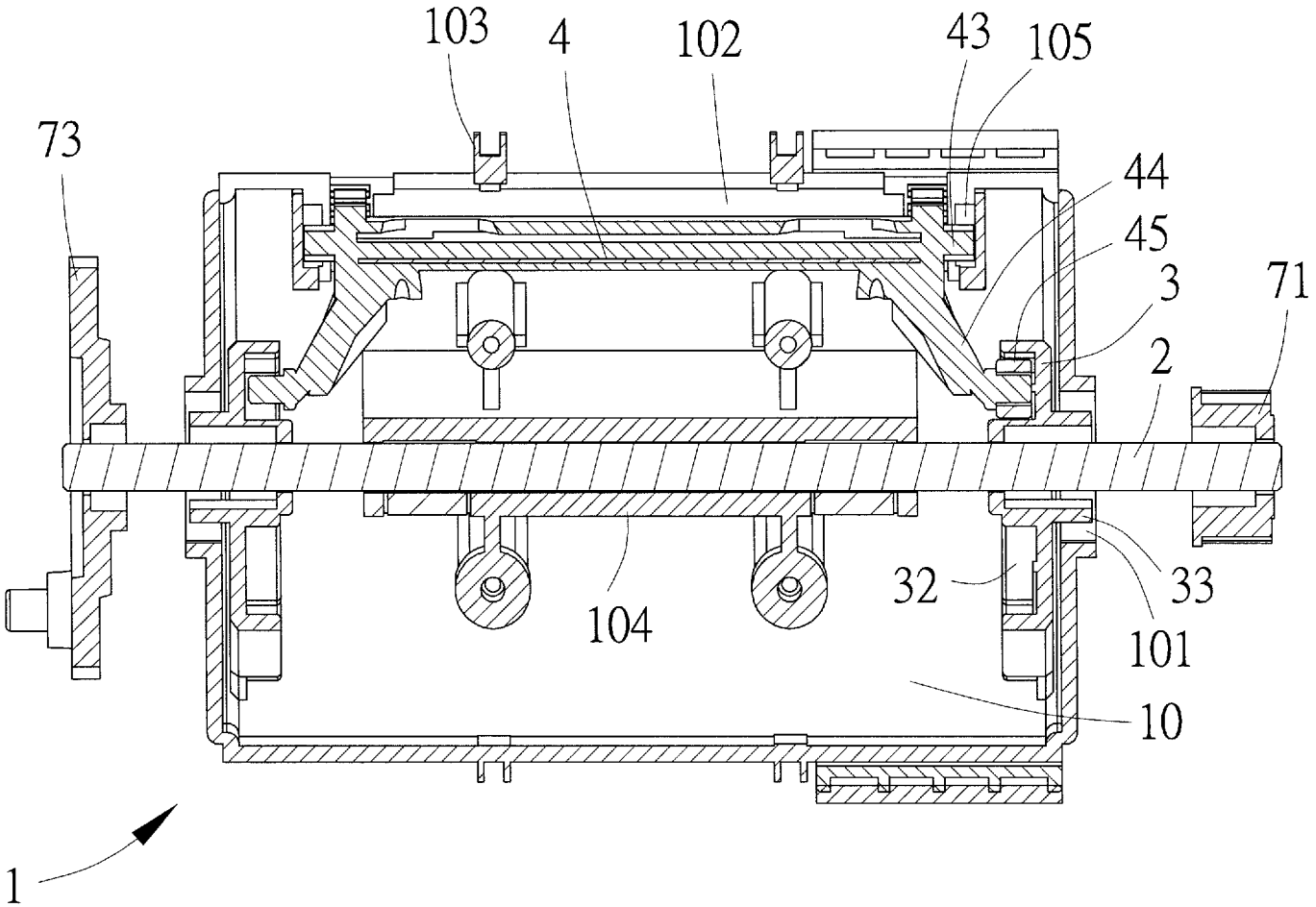
FIG. 5 is a sectional diagram showing the main spindle of FIG. 4.
Figure 9:
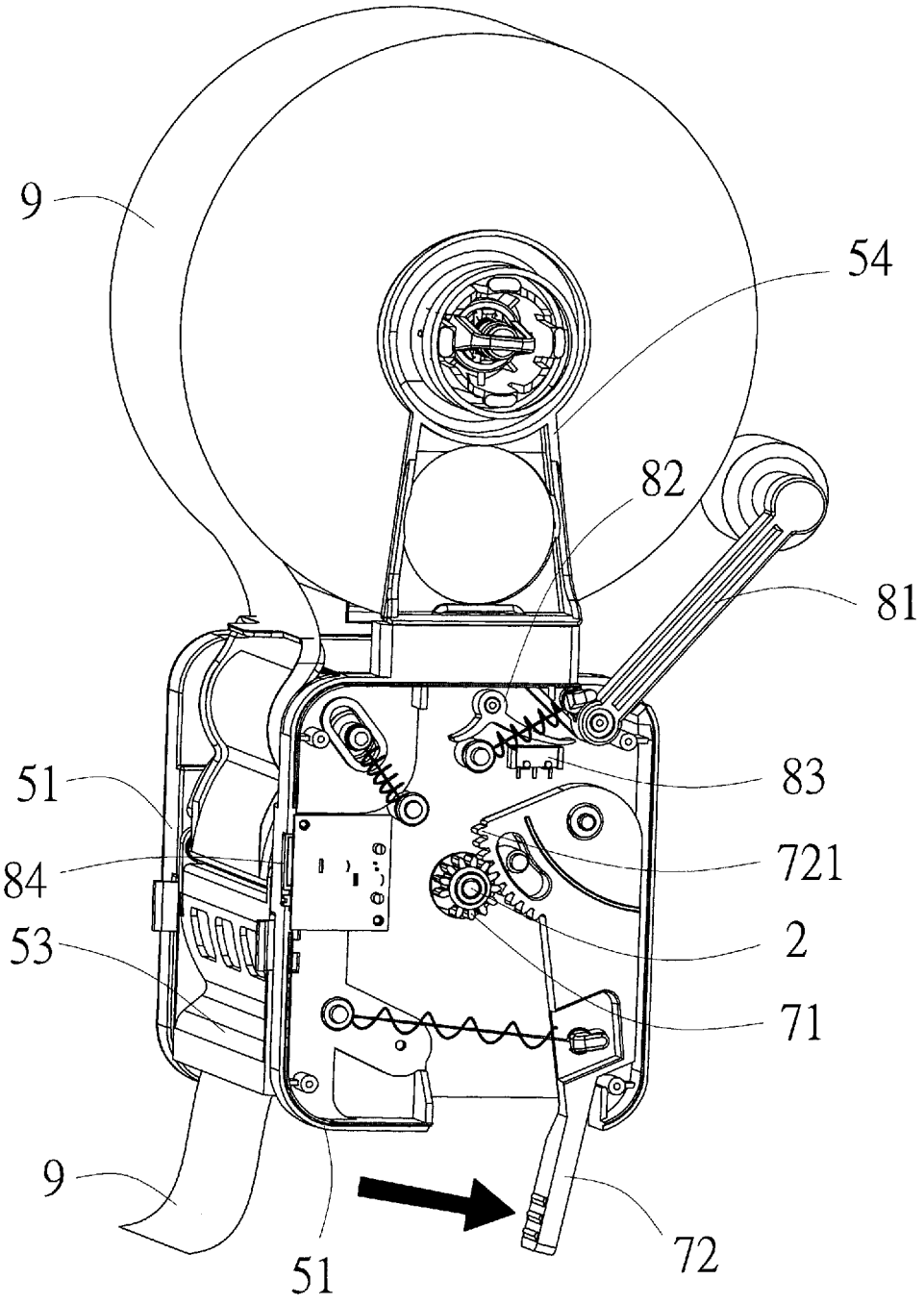
FIG. 9 a perspective diagram showing the paper dispensing device of FIG. 6 when a lever is engages to dispense a length of paper.

As shown in FIGS. 3, 6, and 9, the side covers 51 are hollow and a gear 71 is configured to a first end of the axle 2 inside a side cover 51. The gear 71 is coupled to and engaged by a fan gear 721 at an end of a lever 72 pivotally configured inside the side cover 51. Another end of the lever 72 is extended outside the side cover 51 and, when pulled, the fan gear 721 is turned and the gear 71 is driven to spin the axle 2 and the main spindle 1 to extend and cut off a length of paper from the paper roll 9.

A swing arm 81 has a flat end contacting with the paper roll 9 and a second end pivotally joined to the inside of a side cover 51. As the paper roll 9 is consumed, the swing arm 81 gradually turned counterclockwise. The second end of the swing arm 81 is linked to a lever 82. The lever 82 may engage a switch 83 which turns on and off an indicator lamp 84. After the paper roll 9 is exhausted, the second end of the swing arm 81 triggers the lever 82 to turn on the indicator lamp 84 so as to signal that the paper roll 9 is run out.

Figure 2:
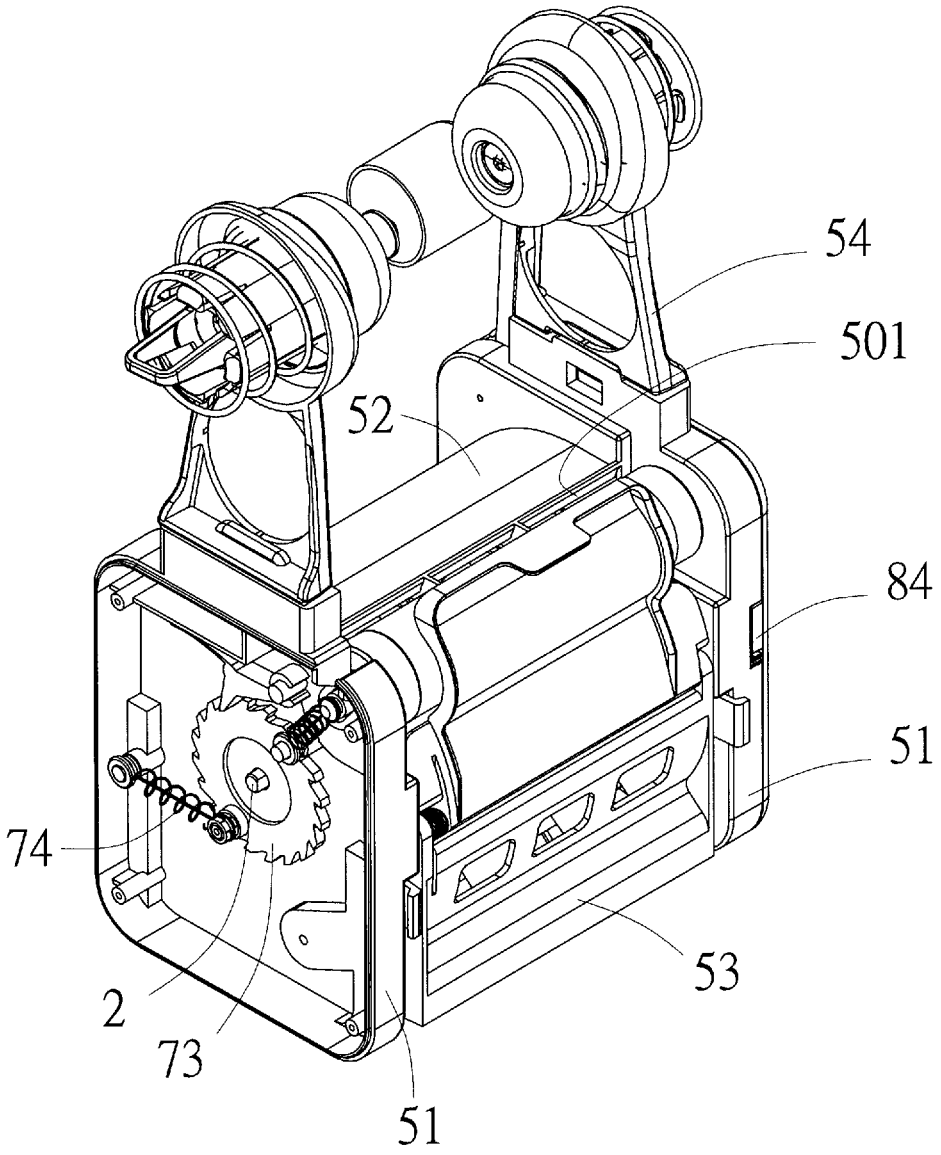
FIG. 2 is another perspective diagram showing the paper dispensing device of FIG. 1 from a different angle.

As shown in FIGS. 2 and 3, another gear 73 is configured to a second end of the axle 2 inside another side cover 51. The gear 73 is tangentially connected to the side cover 51 by a spring 74 so as to restore in a reversed direction the main spindle 1 to an original position after the main spindle 1 is turned by pulling the paper roll 9.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A paper dispensing device, comprising a main spindle having a compartment, two through openings at both ends, and a first slot opening on a lateral surface of the main spindle connecting the compartment;

an axle rotatably supported inside the compartment, whose two ends are extended outside the main spindle via the through openings, respectively;

two end pieces positioned adjacent to the two ends of the axle and the through openings, respectively, where each end piece has an eccentric opening through which an end of the axle is threaded, a ring groove is configured around the eccentric opening along an inner side of each end piece, and an axially and outward protruding first positioning element is configured on an outer side of each end piece extending through one of the through openings;

a cutting member comprising a blade, a cutter axle along a major edge of the blade, two arms extended outward slantwise from the cutter axle's two ends, and two guiding elements at the arms' outer ends moveably housed in the ring grooves, respectively;

wherein the cutting member is positioned along the first slot opening; the main spindle, the axle, and the cutting member are rotated synchronously; the end pieces and their ring grooves are fixed by the first positioning elements; and, as the main spindle spins, the cutting member rotates along with the main spindle and its blade is extended or retracted through the first slot opening as the guiding elements move along the ring grooves.

2. The paper dispensing device according to claim 1, wherein each ring groove comprises a semi-circular segment around the eccentric opening, a corner segment opposing the semi-circular segment, a curved segment connecting the semi-circular segment and the corner segment, and a linear segment opposite to the curved segment also connecting the semi-circular segment and the corner segment; when the guiding elements moves from the semi-circular segments, via the curved segments, and to the corner segments along the ring grooves, the blade supported by the arms are extended out of the first slot opening; and, when the guiding elements subsequently moves through the linear segments back to the semi-circular segments along the ring grooves, the arms retract the blade into the compartment.

3. The paper dispensing device according to claim 2, wherein each guiding element is a roller; two sockets are provided inside the compartment adjacent to the first slot opening for rotatably housing the cutter axle's two ends; at least a partition runs perpendicularly through the first slot opening; the blade has at least a notch corresponding to the partition; and the partition blocks the notch and confines the range of the blade's extension out of the first slot opening.

4. The paper dispensing device according to claim 3, wherein the main spindle comprises a first half cylinder, a second half cylinder, and a tubular sleeve; the first and second half cylinders comprises lateral surfaces and end surfaces at both ends, respectively; the first and second half cylinders are joined to form a cylinder with the compartment inside, the two through openings at both ends, and the first slot opening on the lateral surface of the cylinder; the tubular sleeve has a C-shaped cross section and a second slot opening; the cylinder formed by the first and second half cylinders is threaded in the tubular sleeve; the lateral surface of the tubular sleeve becomes the lateral surface of the main spindle; the compartment is exposed through the first and second slot openings; corresponding support elements are configured inside the first and second half cylinders, respectively; when the first and second half cylinders are joined, their support elements match against each other and jointly provide an axle channel wrapping the axle.

5. The paper dispensing device according to claim 4, further comprising a rack; the axle have its two ends pivotally joined to the rack; the first positioning elements of the end pieces are locked to the rack; a paper roll is mounted on the rack; the paper of the paper roll runs around the main spindle; the blade of the cutting member is extended out of the first slot opening to cut off the paper.

6. The paper dispensing device according to claim 5, wherein the paper roll is one of a roll of toilet paper, tissue paper, paper towel, and napkin.

7. The paper dispensing device according to claim 6, wherein the rack comprises two side covers; each side cover has an axle socket on an inner wall where an end of the axle is rotatably plugged; each axle socket is surrounded a second positioning element; and the first and second positioning elements are tubular in shape and are locked together.

8. The paper dispensing device according to claim 7, wherein the rack further comprises a back cover and a front cover; the back and front covers are configured between the side covers so that an accommodation space is formed among the side, back, and front covers; the main spindle is pivotally mounted inside the accommodation space; a paper roll support rack is configured on a top side of each side cover; a paper input slot is formed between top sides of the front and back covers, and a paper output slot is formed between bottom sides of the front and back covers; and the paper roll's paper is extended into the paper input slot, through the accommodation space, and out of the paper output slot.

9. The paper dispensing device according to claim 8, wherein a first gear is configured to a first end of the axle inside a first side cover; the first gear is coupled to and engaged by a fan gear at an end of a lever pivotally configured inside the first side cover; another end of the lever is extended outside the first side cover; a second gear is configured to a second end of the axle inside a second side cover; the second gear is tangentially connected to the second side cover by a spring so as to restore in a reversed direction the main spindle to an original position after the main spindle is turned; a swing aim has a first end contacting with the paper roll and a second end pivotally joined to the inside of a side cover; as the paper roll is consumed, the swing arm gradually turned counterclockwise; the second end of the swing arm is linked to a lever; the lever engages a switch which turns on and off an indicator lamp; an upper auxiliary spindle and a lower auxiliary spindle are configured between the side covers; the upper auxiliary spindle is adjacent and parallel to the paper input slot and the lower auxiliary spindle is adjacent and parallel to the paper output slot.

* * * * *